US010751906B2

(12) United States Patent
Hundegger

(10) Patent No.: US 10,751,906 B2
(45) Date of Patent: Aug. 25, 2020

(54) WOOD PROCESSING SYSTEM

(71) Applicant: Hans Hundegger, Hawangen (DE)

(72) Inventor: Hans Hundegger, Hawangen (DE)

( * ) Notice: Subject to any disclaimer, the term of this patent is extended or adjusted under 35 U.S.C. 154(b) by 299 days.

(21) Appl. No.: 15/743,461

(22) PCT Filed: Jun. 16, 2016

(86) PCT No.: PCT/EP2016/063870

§ 371 (c)(1),
(2) Date: Jan. 10, 2018

(87) PCT Pub. No.: WO2017/045786

PCT Pub. Date: Mar. 23, 2017

(65) Prior Publication Data

US 2018/0200914 A1 Jul. 19, 2018

(30) Foreign Application Priority Data

Sep. 16, 2015 (DE) ..... 20 2015 104 914 U

(51) Int. Cl.
*B27C 9/02* (2006.01)
*B27M 1/08* (2006.01)
*B27B 29/02* (2006.01)

(52) U.S. Cl.
CPC ..... *B27C 9/02* (2013.01); *B27B 29/02* (2013.01); *B27M 1/08* (2013.01)

(58) Field of Classification Search
CPC .... B27C 5/00; B27C 5/02; B27C 5/06; B27C 9/00; B27C 9/02; B27M 1/08; B27B 29/00; B27B 29/02; B27B 29/04; B27B 29/08
See application file for complete search history.

(56) References Cited

U.S. PATENT DOCUMENTS 6,196,283 B1 3/2001 Hundegger

FOREIGN PATENT DOCUMENTS

| | | | |
|---|---|---|---|
| CN | 101559597 | A | 10/2009 |
| CN | 101559598 | A | 10/2009 |
| DE | 19831284 | A1 | 1/2000 |
| DE | 102010007378 | A1 | 8/2011 |

(Continued)

OTHER PUBLICATIONS

International Preliminary Report on Patentability dated Mar. 20, 2018 for PCT/EP2016/063870 filed Jun. 16, 2016.

(Continued)

*Primary Examiner* — Matthew Katcoff
(74) *Attorney, Agent, or Firm* — Paul D. Bianco; Stephen Bongini; Fleit Intellectual Property Law

(57) ABSTRACT

A wood processing system has a processing assembly containing a carrier movable in a second linear axis at right angles to a first linear axis and a third linear axis perpendicular to it, on which a processing unit designed as a motor spindle to accommodate at least one rotationally driven processing tool is arranged to pivot around three axes of rotation. The processing unit is arranged to pivot around a third axis of rotation spaced from the first axis of rotation on the free end of an arm pivotable on the carrier around a first axis of rotation and a second axis of rotation perpendicular to the first axis of rotation. The arm is arranged rotatable by 360° around the second axis of rotation on a front carrier part, which is arranged to rotate around the first axis of rotation perpendicular to the first linear axis on a front end face of the carrier.

17 Claims, 2 Drawing Sheets

(56) References Cited

FOREIGN PATENT DOCUMENTS

| | | |
|---|---|---|
| EP | 0988924 A2 | 3/2000 |
| WO | 0236302 A1 | 5/2002 |

OTHER PUBLICATIONS

Written Opinion for PCT/EP2016/063870 filed Jun. 16, 2016.
Intrenational Search Report dated Sep. 7, 2016 for PCT/EP2016/063870 filed Jun. 16, 2016.

WOOD PROCESSING SYSTEM

FIELD OF THE INVENTION

The invention concerns a wood processing system.

BACKGROUND OF THE INVENTION

Such a wood processing system is known from DE 10 2010 007 378 A1. A processing assembly arranged between a front and rear support area of a tool support has a carrier movable in two axes at right angles to each other, on which a processing unit designed as a motor spindle to accommodate at least one rotationally driven tool is arranged to pivot around three axes of rotation. The processing unit designed as a motor spindle is arranged to pivot on the carrier around a third axis of rotation spaced from the first axis of rotation on the free end of an arm pivotable around a first axis of rotation and a second axis of rotation perpendicular to the first axis of rotation. The arm holding the processing unit in this known wood processing system is arranged rotatable by 180° around a second axis of rotation (B axis) perpendicular to the first axis of rotation (A axis) on a U-shaped mount rotatable around a first axis of rotation (A axis). The processing unit is arranged rotatable around a third axis of rotation (C axis) spaced from the first axis of rotation (A axis) on the laterally protruding free end of the arm. Through such an arrangement all six sides of a workpiece can be processed without overturning or reclamping processes, although larger travel movements must be conducted for certain processing tasks.

SUMMARY OF THE INVENTION

In an embodiment of the invention, a wood processing system makes possible six-sided processing of workpieces without overturning devices or reclamping processes with fewer travel movements and a reduced control expense.

Expedient modifications and advantageous embodiments of the invention are also disclosed.

The arm holding the processing unit in the wood processing system according to the invention is rotatable by 360° around the second axis of rotation (B axis) on a front carrier part arranged to rotate around the first axis of rotation (A axis) perpendicular to the first linear axis (X axis) on a front end face of the carrier. The arm holding the processing unit can therefore be rotated without restriction relative to the carrier so that improved accessibility to all surfaces of the workpiece being processed is made possible. In addition to the top and bottom of the workpiece, the rear and front, as well as faces of the workpiece can also be processed without overturning without more or greater travel and pivot movements of the processing unit. In particular, the processing unit can be moved so that the tool axis of rotation is also perpendicular to the surfaces of the workpiece on the rear and front of the workpiece so that holes, millings, recesses, or the like running perpendicular to the surface there can be introduced. More rapid and more efficient processing is made possible through such expanded movement capabilities.

In a particularly expedient embodiment, the carrier part rotatable around the first axis of rotation is designed as a horizontal support element protruding from the front face of the carrier with a support surface parallel to the first linear axis (X axis). The arm holding the processing unit can be arranged to be rotatable by 360° on the support surface.

The arm is expediently designed to be angled and has a lower leg arranged on the support surface of the carrier part, as well as a support part extending laterally from the carrier part at right angles to it. The processing unit rotatable around the third axis of rotation (C axis) can be arranged on an inner contact surface of the support part.

In an advantageous embodiment, the arm can be arranged on the carrier part so that the tool axis of rotation D of a rotationally driven tool mount of the processing unit (13) and the second axis of rotation (B axis) lie in the same plane. Control can be simplified on this account and the programming expense reduced. This can be achieved in that the support part of the arm is offset relative to the second axis of rotation. The arm is also expediently arranged on the front carrier face so that the second axis of rotation (B axis) and the third axis of rotation (C axis) lie in one plane.

The transport device conceived for displacement of the workpiece along the first linear axis expediently consists of at least one transport slide movable by a motor on a guide in the first linear axis (X axis), which can have clamping jaws for fastening and/or smooth guiding of the workpiece during processing. A fixed clamping jaw and a clamping jaw movable relative to it can be involved here, containing additional guide rolls for smooth guiding of the workpieces in addition to fixed clamping areas. Clamping jaws adjustable relative to each other, however, can also be provided.

Additional details and advantages of the invention are apparent from the following description of a preferred practical example with reference to the drawing. In the drawing:

DETAILED DESCRIPTION OF THE INVENTION

Figure 1:
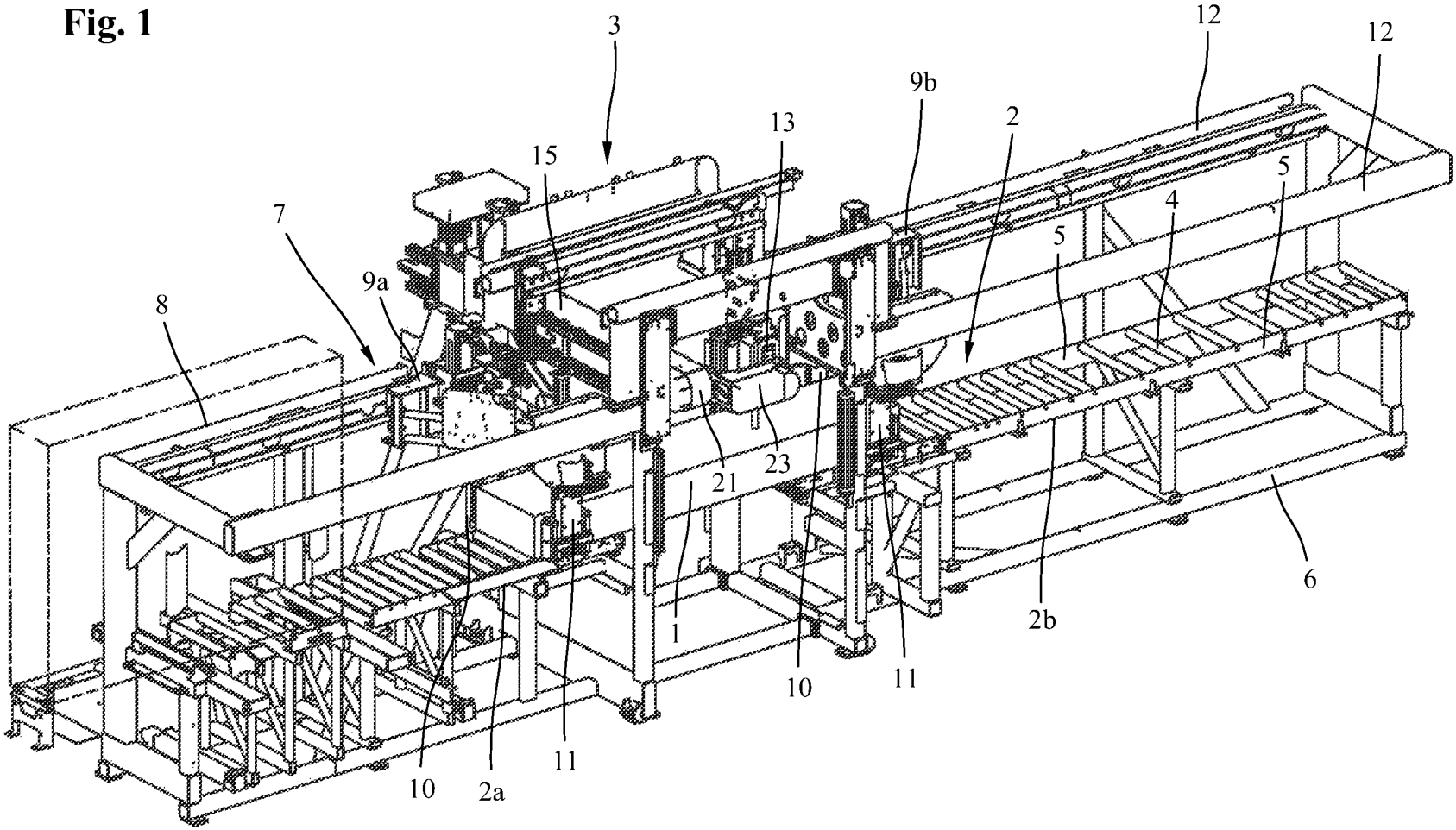
FIG. 1 shows a wood processing system according to the invention in a perspective view and FIG. 2 shows an enlarged partial view of the wood processing system of FIG. 1.

The wood processing system depicted schematically in a perspective view in FIG. 1 is conceived especially for six-sided processing of elongated workpieces 1, such as wooden beams, boards, panels, and the like. It contains a workpiece support 2 designed here as a roller track with a front support area 2*a* as viewed in the transport direction and a rear support area 2*b* spaced from the front support area 2*a*. A processing assembly 3 as further explained below is arranged between the front and rear support areas 2*a* and 2*b* of the workpiece support 2. The front and rear support areas 2*a* and 2*b* contain a number of transport rollers 4 arranged one behind the other, mounted to rotate between the parallel rails 5. The rails 5 having transport rollers 4 mounted rotatably in between are arranged on a frame 6 designed here as a welded structure. The front and rear support areas 2*a* and 2*b* can have a fixed spacing. At least one of the two support areas 2*a*, 2*b*, however, can also be moved horizontally in the direction of the first linear axis (X axis) so that workpiece support can occur as close as possible to the tool.

This wood processing system also contains a transport device 7 with which a workpiece 1 lying on the workpiece support 2 can be moved horizontally relative to the workpiece support 2 and to the processing assembly 3 in the direction of a first linear axis (X axis). The transport device 7 contains two or more transport slides 9*a* and 9*b* movable by a motor in the first linear axis (X axis) on a guide 8 in the longitudinal direction of the workpiece support 2, each of which carries a fixed clamping jaw 10 and a clamping jaw 11 that can be moved transversely to it. The guide 8 in the depicted embodiment has two guide rails 12 arranged parallel above the workpiece support 2 over the front and rear support areas 2*a* and 2*b*, between which the transport slides 9*a* and 9*b* can be displaced in controlled fashion by corresponding drives over the entire area of the workpiece support 2 using the downward extending clamping jaws 10 and 11. The guide rails 12 can be designed in sections and laid out so that individual areas of the guide rails can be opened, if necessary, in order to permit a greater range of travel of the processing assembly 3.

The transport slides 9*a* and 9*b* are laid out so that they not only firmly clamp the workpiece 1 between the two clamping jaws 10 and 11 by corresponding adjustment of the moving clamping jaws 11 and transport it in the direction of the first linear axis (X axis), but can also guide the workpiece 1, as required. For example, the two clamping jaws 10 and 11 of the rear transport slide 9*b* in the transport direction can firmly clamp the workpiece 1 and transport it by moving the transport slide 9*b*, whereas the two clamping jaws 10 and 11 of the front transport slide 9*a* in the transport direction can slide the workpiece 1. The workpiece 1, however, can also be clamped by the clamping jaws 10 and 11 of both transport slides 9*a* and 9*b* and secured for processing or be moved by simultaneous movement of both transport slides 9*a* and 9*b*. If required, the workpiece 1 can also be transported only by the front transport slide 9*a* in the transport direction, whereas the rear transport slide 9*b*, which is arranged in the transport direction, guides the workpiece 1 in a sliding manner.

Figure 2:
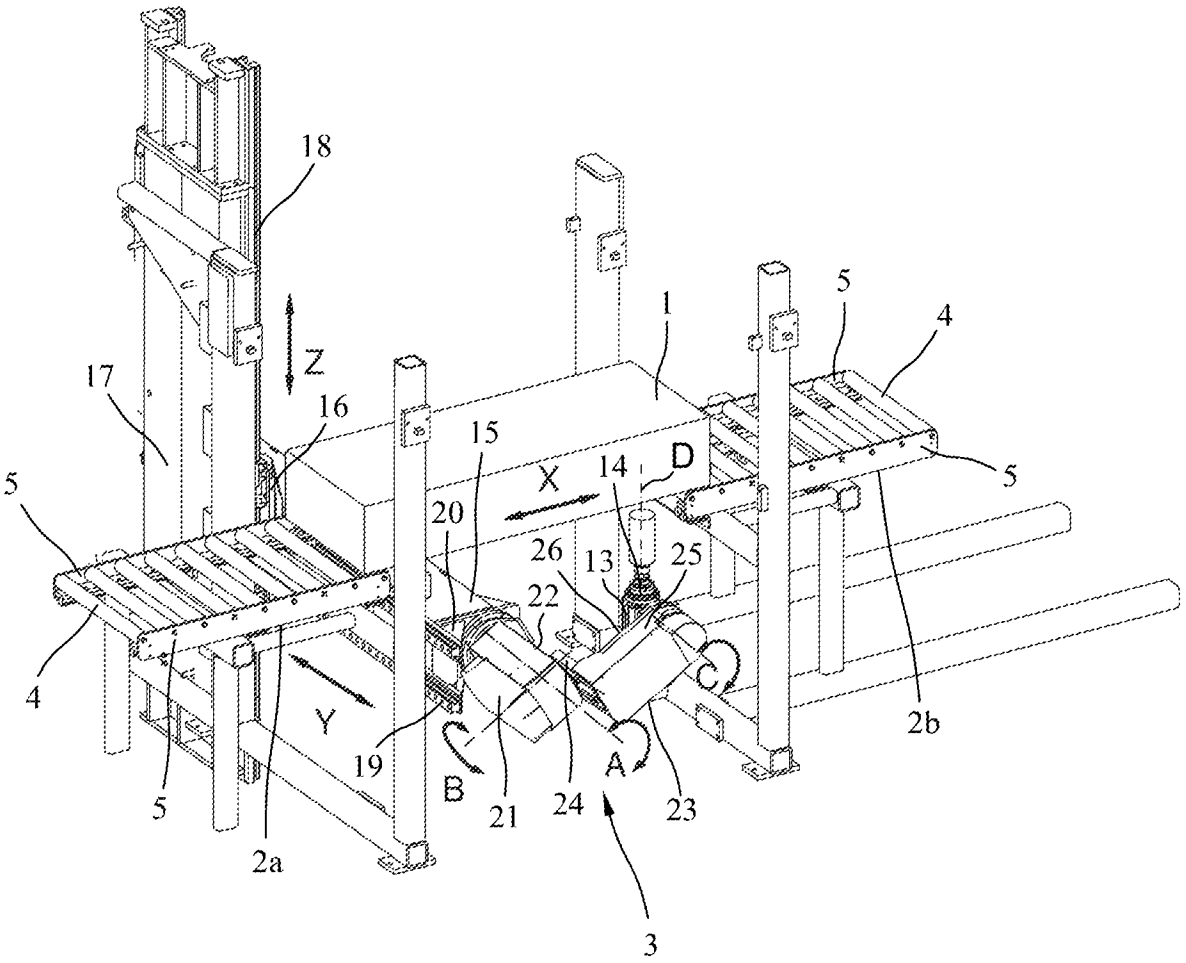

The processing assembly 3 arranged between the front support area 2*a* and the rear support area 2*b* of the workpiece support 2 includes, according to FIG. 2, a processing unit 13, movable in several axes, which is designed in the depicted embodiment as a motor spindle having a workpiece mount 14 rotationally driven around a workpiece axis of rotation D for accommodation of a milling cutter, a drill, a saw blade, or other tools. The processing unit 13, however, can also be configured differently to perform other processes or, for example, to apply markings.

For movement of the processing unit 13 in axes, the processing assembly 3 contains a horizontal carrier 15 arranged transversely to the workpiece support 2 between the front and rear support areas 2*a* and 2*b*, which is arranged movable on a frame 17 horizontally and vertically in a Y and Z axis via a slide 16. The carrier 15 in the depicted embodiment is designed as a horizontal transverse carrier running perpendicular to the first linear axis (X axis). The frame 17 is designed to be stationary, but in a further expansion stage could also be movable in the X axis. The slide 16 is arranged to be vertically movable via vertical guide rails 18 on frame 17 in a second linear axis (Z axis) perpendicular to the first linear axis (X axis). The carrier 15 is movable horizontally via horizontal guide rails 19 on the slide 16 in a third linear axis (Y axis) perpendicular to the first and second linear axes.

A horizontally extending front carrier part 21 is arranged to rotate around a first axis of rotation (A axis) perpendicular to the first linear axis (X axis) on a front end face 20 of the front end of horizontal carrier 15 extending between the front and rear support areas 2*a* and 2*b*. The front carrier part 21 is designed as a horizontal support element protruding from the front end face 20 with a support surface 22 parallel to the first axis of rotation (A axis). An angled arm 23 is arranged on the support surface 22 of the front carrier part 21 pivotable by 360° around a second axis of rotation (B axis) perpendicular to the first axis of rotation (A axis). The angled arm 23 has a lower leg 24 lying on the support surface 22 of the front carrier part 21 and a support part 25 laterally extending from the front carrier part 21 perpendicular to it with an inner contact surface 26.

The processing unit 13 designed as a motor spindle is arranged rotatable around a third axis of rotation (C axis) spaced from the first axis of rotation (A axis) and perpendicular to the second axis of rotation (B axis) on the free end of the arm 23 also pivotable by a motor around the second axis of rotation (B axis). The processing unit 13 is arranged on the inner contact surface 26 of the support part 25 perpendicular to the support surface 22. The third axis of rotation (C axis) is arranged parallel to the first axis of rotation (A axis) via the angled arm 23 with the support part 25 extending at right angles from the front carrier part 21. The processing unit 13 is rotatable around the third axis of rotation (C axis) by a motor. All drive motors are controlled so that the processing unit 13 can execute controlled movement relative to workpiece 1. A milling cutter, a drill, a saw, or other appropriate tool can be tightened in the workpiece mount 14 of processing unit 13 rotatable by motor around the tool axis of rotation D. The tool axis of rotation D is aligned at right angles to the third axis of rotation (C axis).

With its front end extending relative to the vertical carrier 19 between the front and rear support areas 2*a* and 2*b*, the carrier 15 can also be moved above and below the workpiece 1 so that the processing unit 13 rotatable in three axes can reach all sides of the workpiece with the tool. For example, in addition to the top and bottom of the workpiece, the rear and front sides of the workpiece 1 can also be processed. The two faces of the workpiece 1 can also be processed. The workpiece 1 transported by the transport device can therefore be processed on all six sides without overturning through the movement capabilities in several axes as just described.

The invention claimed is:

1. A wood processing system comprising:

a workpiece support for workpieces being processed;

at least one processing assembly arranged between a front support area and a rear support area of the workpiece support; and a transport device to move the workpieces lying on the workpiece support relative to the workpiece support and to the processing assembly in a direction of a first linear axis, the processing assembly having a carrier movable in a direction of a second linear axis perpendicular to the first linear axis and a direction of a third linear axis perpendicular to the first linear axis, on which a processing unit comprising a motor spindle to accommodate at least one rotationally driven processing tool is arranged to pivot around three axes of rotation, the processing unit being arranged to pivot around a third axis of rotation spaced from the first axis of rotation on a free end of an arm pivotable on the carrier around a first axis of rotation and a second axis of rotation perpendicular to the first axis of rotation, wherein the arm is arranged on a front carrier part rotatable by 360° around the second axis of rotation, which is arranged to rotate around the first axis of rotation perpendicular to the first linear axis on a front end face of the carrier.

2. The wood processing system according to claim 1, wherein the front carrier part comprises a horizontal support element protruding from the front end face of the carrier with a support surface parallel to the first axis of rotation.

3. The wood processing system according to claim 2, wherein the arm is arranged rotatable by 360° on the support surface of the front carrier part.

4. The wood processing system according to claim 2, wherein the arm is angled and includes a lower leg arranged on the support surface of the front carrier part, and a support part extending laterally from the front carrier part, the support part being perpendicular to it the lower leg.

5. The wood processing system according to claim 4, wherein the processing unit is arranged on an inner contact surface of the support part.

6. The wood processing system according to claim 1, wherein the motor spindle has a mount rotationally driven around a tool axis of rotation, and the arm is arranged on the front carrier part so that the tool axis of rotation lies in the same plane as the second axis of rotation.

7. The wood processing system according to claim 4, wherein the support part of the arm is offset relative to the second axis of rotation.

8. The wood processing system according to claim 1, wherein the arm is arranged on the front carrier part so that the second axis of rotation and the third axis of rotation lie in one plane.

9. The wood processing system according to claim 1, wherein the carrier comprises a horizontal transverse carrier that can be moved with its front end face between the front support area and the rear support area of the workpiece support.

10. The wood processing system according to claim 1, wherein the carrier is movable on at least one of a vertically and horizontally movable slide.

11. The wood processing system according to claim 1, wherein the transport device has at least one transport slide that can be motor-driven on a guide in the direction of the first linear axis.

12. The wood processing system according to claim 11, wherein each of the at least one transport slides includes:

a fixed clamping jaw and a another clamping jaw movable relative to the fixed clamping jaw, or two movable clamping jaws.

13. The wood processing system according to claim 1, wherein the front carrier part comprises a horizontal support element protruding from the front end face of the carrier with a support surface parallel to the first axis of rotation, and the arm comprises a lower leg lying on the support surface of the front carrier part, and a support part laterally extending from the front carrier part so as to be perpendicular to the lower leg.

14. The wood processing system according to claim 13, wherein the support part is offset relative to the second axis of rotation, and the processing unit is arranged on the support part.

15. The wood processing system according to claim 1, wherein the motor spindle has a mount rotationally driven around a tool axis of rotation, and the processing unit is moveable so as to make the tool axis of rotation perpendicular to a rear surface and a front surface of the workpiece.

16. The wood processing system according to claim 1, wherein the motor spindle has a mount rotationally driven around a tool axis of rotation, and the processing unit is moveable so as to make the tool axis of rotation perpendicular to a rear surface and a front surface of the workpiece so as to allow the processing tool to operate perpendicular to the rear and front surfaces of the workpiece.

17. The wood processing system according to claim 1, wherein the motor spindle has a mount rotationally driven around a tool axis of rotation, the arm is arranged on the front carrier part such that the tool axis of rotation lies in the same plane as the second axis of rotation, and the processing unit is moveable so as to make the tool axis of rotation perpendicular to a rear surface and a front surface of the workpiece.

* * * * *